US005171197A

United States Patent [19]

Healy et al.

[11] Patent Number: 5,171,197

[45] Date of Patent: Dec. 15, 1992

[54] REFLEX TRAINING APPARATUS

[76] Inventors: Randall Healy, 1111 W. Genesee Ave., Flint, Mich. 48506; Daniel L. Olmstead, 9465 N. Linden Rd., Clio, Mich. 45420

[21] Appl. No.: 714,507

[22] Filed: Jun. 13, 1991

[51] Int. Cl.[5] ..... A63B 69/34

[52] U.S. Cl. ..... 482/83; 482/87

[58] Field of Search ..... 482/83, 84, 85, 86, 482/87

[56] References Cited

U.S. PATENT DOCUMENTS

| | | | |
|---|---|---|---|
| 4,564,192 | 1/1986 | Lebowitz | 482/87 |
| 4,662,630 | 5/1987 | Dignard et al. | 482/83 |
| 4,946,159 | 8/1990 | Jones | 482/83 |

*Primary Examiner*—Stephen R. Crow

*Attorney, Agent, or Firm*—Leon Gilden

[57] ABSTRACT

An apparatus wherein a mounting plate is secured to a support plate, and the support plate in turn including saddle members for securement to a rearwardly positioned post. The support plate includes an upper and lower fastener to permit rotary positioning of the support plate to the mounting plate to orient an impact post rotatably relative to the support plate. The impact post is mounted to a spring hinge front plate, with the spring hinge front plate including a plurality of spring hinge members hingedly mounting the front plate to a rear plate. The front plate is hingedly mounted permitting one hundred eighty degrees of motion of the mounting post securing the impact post. A modification of the invention includes a clutch member joining the mounting post to the spring hinge front plate.

7 Claims, 4 Drawing Sheets

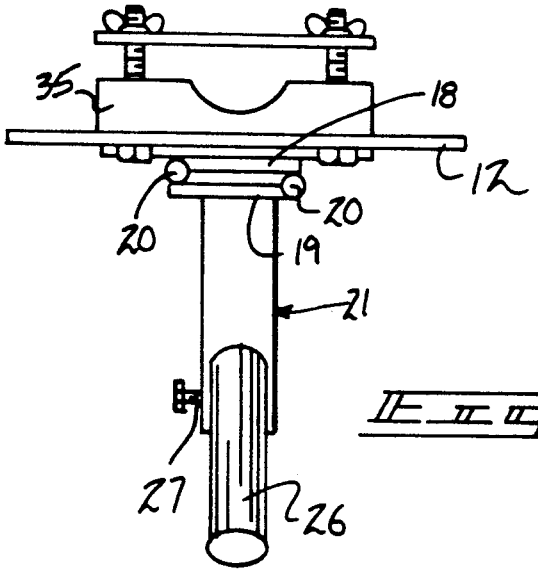
Fig 2
Fig 3
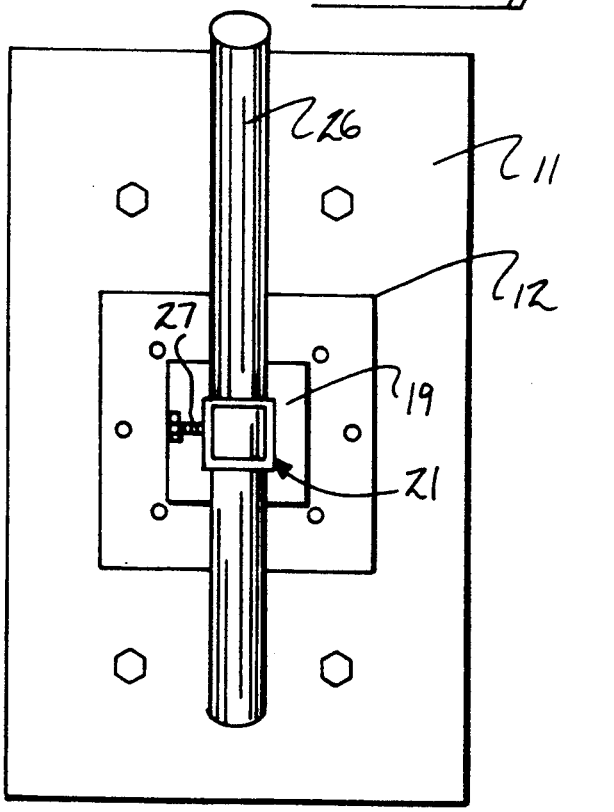

REFLEX TRAINING APPARATUS

BACKGROUND OF THE INVENTION

1. Field of the Invention

The field of invention relates to training apparatus, and more particularly pertains to a new and improved reflex training apparatus wherein the same is utilized in martial arts training providing a target and resilient rebounding of the target to an additional positioning when displaced therefrom upon impacting by an individual.

2. Description of the Prior Art

Various martial arts training apparatus is utilized in the prior art to accommodate impact. Such patents are exemplified by U.S. Pat. No. 4,564,192 to Lebowitz wherein a martial arts device includes impact members that are spring-biased relative to a support post.

U.S. Pat. No. 4,387,892 to Wen sets forth a dummy-type configuration, with an oscillating sword used in practicing of martial arts.

U.S. Pat. No. 4,819,934 to Wilson sets forth an organization presenting a boxing robot device.

U.S. Pat. No. 4,836,533 to Dong sets forth a tension-loaded striking apparatus wherein a vertically oriented post is displaceable upon impact by an individual.

As such, it may be appreciated that there continues to be a need for a new and improved reflex training apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of training apparatus now present in the prior art, the present invention provides a reflex training apparatus wherein the same hingedly and rotatably mounts an impact post for training in martial arts by an individual. As such, the general purpose of the present invention, which will be described subsequently in greater detail, is to provide a new and improved reflex training apparatus which has all the advantages of the prior art training apparatus and none of the disadvantages.

To attain this, the present invention provides an apparatus wherein a mounting plate is secured to a support plate, and the support plate in turn including saddle members for securement to a rearwardly positioned post. The support plate includes an upper and lower fastener to permit rotary positioning of the support plate to the mounting plate to orient an impact post rotatably relative to the support plate. The impact post is mounted to a spring hinge front plate, with the spring hinge front plate including a plurality of spring hinge members hingedly mounting the front plate to a rear plate. The front plate is hingedly mounted permitting one hundred eighty degrees of motion of the mounting post securing the impact post. A modification of the invention includes a clutch member joining the mounting post to the spring hinge front plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reflex training apparatus which has all the advantages of the prior art training apparatus and none of the disadvantages.

It is another object of the present invention to provide a new and improved reflex training apparatus which may be easily and efficiently manufactured and marketed.

It is a further object of the present invention to provide a new and improved reflex training apparatus which is of a durable and reliable construction.

An even further object of the present invention is to provide a new and improved reflex training apparatus which is susceptible of a low cost of manufacture with regard to both materials and labor, and which accordingly is then susceptible of low prices of sale to the consuming public, thereby making such reflex training apparatus economically available to the buying public.

Still yet another object of the present invention is to provide a new and improved reflex training apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic top view of the instant invention.

FIG. 3 is a front orthographic view, taken in elevation, of the instant invention.

FIG. 6 is an isometric exploded illustration of the clutch mechanism utilized by the instant invention.

DESCRIPTION OF THE PREFERRED EMBODIMENT

Figure 1:
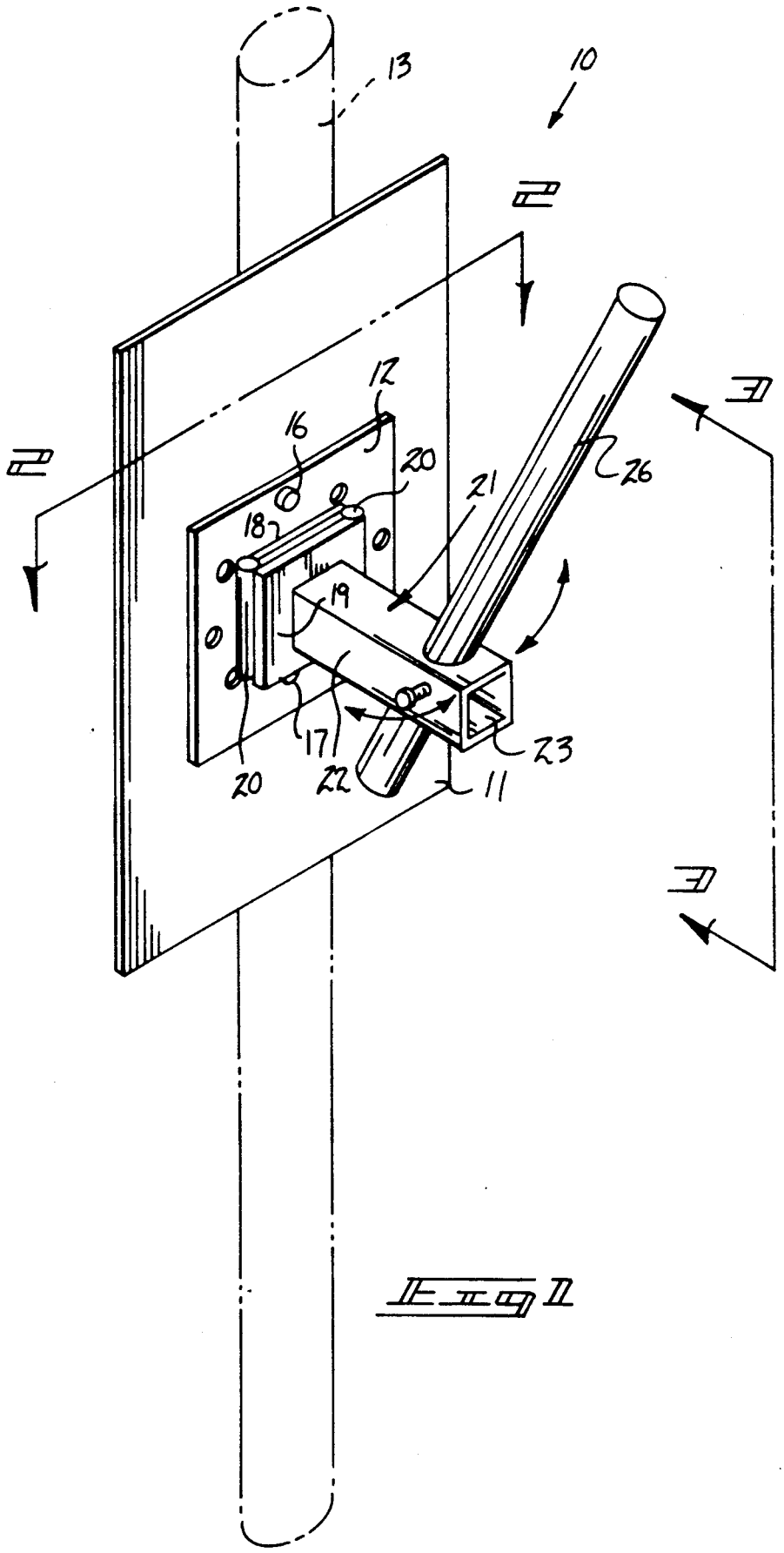
FIG. 1 is an isometric illustration of the instant invention.
Figure 4:
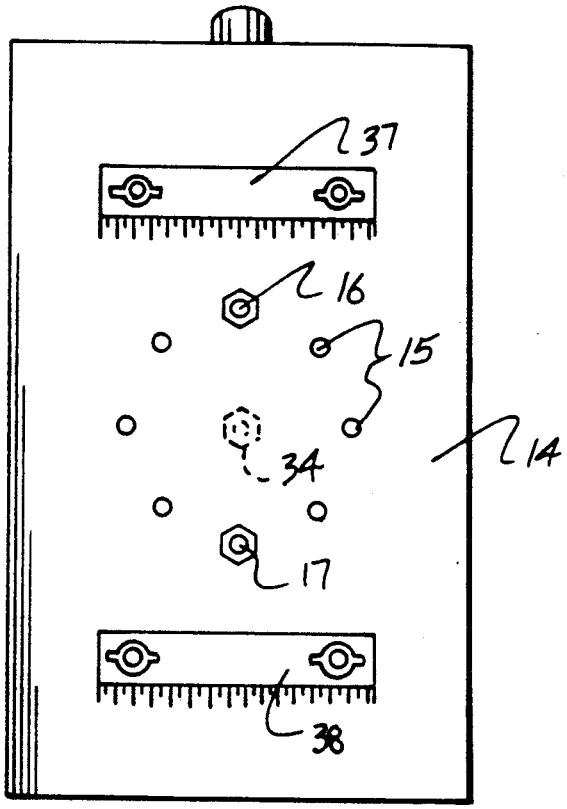
FIG. 4 is a rear orthographic view of the invention.

With reference now to the drawings, and in particular to FIGS. 1 to 6 thereof, a new and improved reflex training apparatus embodying the principles and concepts of the present invention and generally designated by the reference numeral 10 will be described.

More specifically, the reflex training apparatus 10 of the instant invention essentially comprises a mounting plate 11 defined by a planar forward surface spaced from and parallel a planar rear surface 14. A support plate 12 is adjustably mounted to the forward surface of the mounting plate 11, wherein a top support plate fastener bolt 16 and a bottom support plate fastener bolt 17 are directed through the support plate 12 and into a plurality of apertures defined by a circular array of apertures 15 (see FIG. 4). The circular array of apertures permits rotatable mounting of the support plate relative to the mounting plate, as illustrated. The support plate is secured to a vertical support post 13 utilizing the top saddle 35 spaced above a lower saddle of equal configuration, with a top clamp 37 capturing the support post 13 between the top clamp plate 37 and the top saddle 35, wherein a bottom clamp plate 38 captures the support post within an identically configured saddle. Each saddle is defined by a concave recess, as illustrated and exemplified in FIG. 2.

A spring hinge rear plate is fixedly mounted to the support plate 12, with a spring hinge front plate 19 hingedly mounted to the spring hinge rear plate 18. A plurality of spring hinge members 20 are arranged parallel relative to one another and positioned in opposed sides and between the spring hinge rear plate 18 and the spring hinge front plate 19, wherein a mounting post 21 orthogonally and medially mounted to a forward surface of the spring hinge front plate 19 is permitted one hundred eighty degrees of arcuate pivotal motion relative to the spring hinge rear plate 18. The mounting post 21 includes a mounting post top wall 22 spaced from and parallel a mounting post bottom wall 23. A top wall opening 22*a* is coaxially aligned with a bottom wall opening 23*a*, wherein the top and bottom wall openings are arranged along a single opening axis (see FIG. 6 for example), and defines an acute included angle 25 between the opening axis 24 and the mounting post top wall 22. An impact rod 26 is slidably received within the plurality of openings defined by the top and bottom wall openings 22*a* and 23*a* and secured therewithin by a clamping fastener 27 directed through the mounting post intersecting the impact rod 26.

In this manner, impact of the impact rod 26 deflects the rod to a point of origin, as illustrated in FIG. 1 enhancing reflex training by an individual in martial arts.

Figure 5:
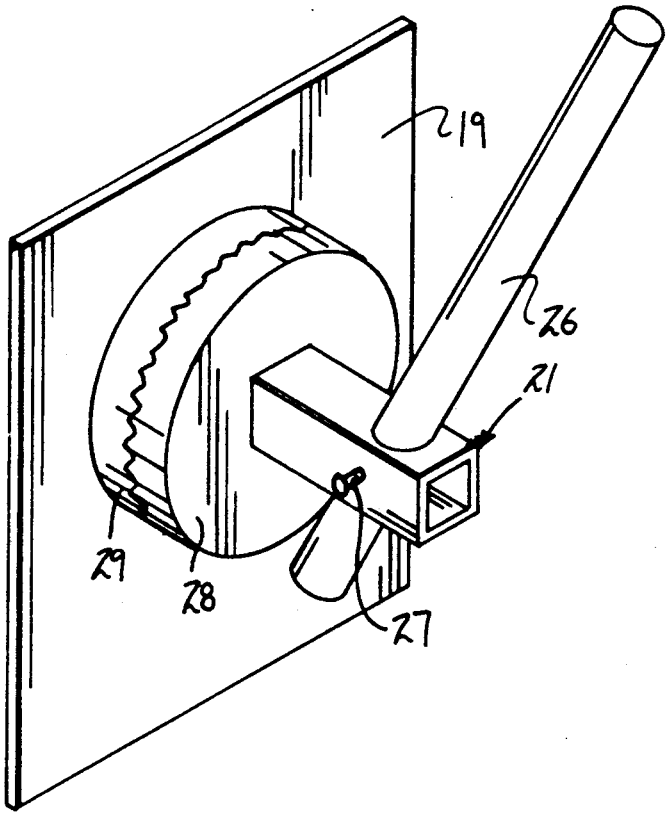
FIG. 5 is an isometric illustration of a modified clutch member utilized for securement to the front hinge plate of the instant invention.
Figure 15:
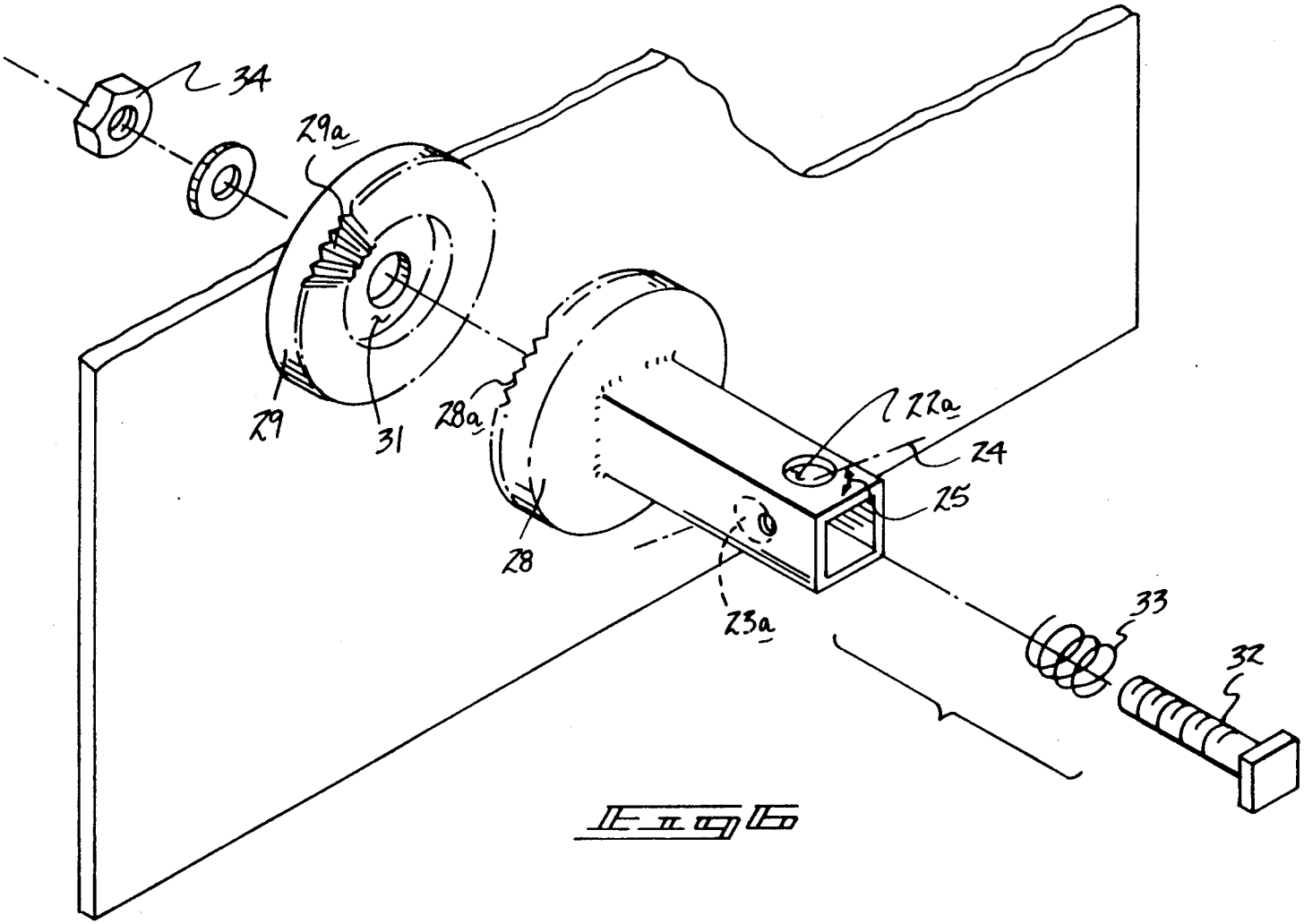

FIGS. 5 and 6 illustrate the use of a clutch arrangement, wherein a forward clutch disc 28 is rotatably mounted to a rear clutch disc 29. The forward clutch disc includes forward clutch disc radial teeth 28*a* in confronting interdigited communication with rear clutch disc radial teeth 29*a*. The forward clutch disc is rotatably mounted relative to the rear clutch disc, wherein striking of the impact rod 26 permits rotation to an adjusted degree of the forward clutch disc 28 relative to the rear clutch disc 29. The rear clutch disc 29 is in turn fixedly secured to the spring hinge front plate 19, as illustrated in FIG. 5. A cylindrical recess 31 is formed within a forward surface of the rear clutch disc 29 medially of the radial teeth 29*a*, wherein a spring 33 is captured between the cylindrical recess 31 and a clutch adjustment bolt 32 that is directed through the rear clutch disc 39 and mounted rearwardly of the spring hinge front plate 19 by a fastener nut 34. Relative tightening of the fastener nut 34 adjusts tensioning of the front disc 28 relative to the rear disc 29 permitting selective or non-rotation thereof, if desired by an individual, to enhance an element of motion of the impact rod 26 in use for training purposes.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A reflex training apparatus, comprising in combination, a mounting plate, the mounting plate including a support plate, and the support plate including securement means, wherein the securement means rotatably mounts the support plate to the mounting plate, said securement means includes a top support plate fastener bolt and a bottom support plate fastener bolt orthogonally directed through the support plate and received within the mounting plate directed therethrough, and the mounting plate including a circular array of apertures, and a plurality of the circular array of apertures receiving the top support plate fastener bolt and the bottom support plate fastener bolt therethrough, and the support plate including a spring hinge rear plate fixedly mounted to a forward surface of the support plate, and a rear surface of the support plate mounted to a forward surface of the mounting plate, and a spring hinge front plate hingedly mounted to the spring hinge rear plate, and spring bias means operatively engaged between said spring hinge plates, and mounting post orthogonally mounted to the spring hinge front plate extending exteriorly thereof in a predetermined orientation, and an impact rod secured within the mounting post whereby impact of the impact rod permits deflection of the impact rod and biasing of the rod to the predetermined orientation.

2. An apparatus as set forth in claim 1 wherein the spring hinge rear plate and the spring hinge front plate include a plurality of spring hinge members oriented parallel relative to one another and positioned between and on opposed sides of the spring hinge rear plate and the spring hinge front plate permitting pivotal motion of the mounting post relative to the support plate.

3. An apparatus as set forth in claim 2 wherein the mounting post includes a mounting post top wall spaced above and parallel a mounting post bottom wall, the mounting post top wall including a top wall opening, and the mounting post bottom wall including a bottom wall opening, the top wall opening and the bottom wall opening coaxially aligned relative to one another, and the top wall opening and bottom wall opening aligned along an opening axis, the opening axis defining an acute included angle between the opening axis and the mounting post top wall.

4. An apparatus as set forth in claim 3 including a clamping fastener directed through the mounting post intersecting the impact rod for securement of the impact rod within the mounting post top wall opening and the mounting post bottom wall opening.

5. An apparatus as set forth in claim 4 including a clutch means for rotatably securing the mounting post relative to the support plate.

6. An apparatus as set forth in claim 5 wherein the clutch means includes a rear clutch disc fixedly mounted to the support plate, and a forward clutch disc rotatably mounted to the rear clutch disc, and the forward clutch disc including a circular array of forward clutch disc radial teeth, and the rear clutch disc including a circular array of rear clutch disc radial teeth, wherein the forward clutch disc radial teeth and the rear clutch disc radial teeth are in contiguous and interdigited communication relative to one another, and the rear clutch disc including a rear clutch disc cylindrical recess, and a clutch adjustment bolt directed through the forward clutch disc and the rear clutch disc received within the rear clutch disc cylindrical recess, with a spring interposed between the clutch adjuster bolt and the cylindrical recess, and a fastener nut mounted to the clutch adjuster bolt to a rear surface of the spring hinge front plate.

7. An apparatus as set forth in claim 6 including a top saddle and a lower saddle mounted to the rear surface of the mounting plate, wherein the top saddle and the lower saddle each include a concave recess, the concave recess arranged for receiving a support post therewithin, and the top saddle including a top clamp plate for clamping the support post between the top clamp plate and the top saddle, and the lower saddle including a bottom clamp plate for securement of the support post between the bottom clamp plate and the lower saddle.

* * * * *